United States Patent [19]

Price

[11] Patent Number: 4,671,170

[45] Date of Patent: Jun. 9, 1987

[54] AIR DIFFUSER

[75] Inventor: Edison A. Price, New York, N.Y.

[73] Assignee: Edison Price Incorporated, New York, N.Y.

[21] Appl. No.: 775,433

[22] Filed: Sep. 12, 1985

[51] Int. Cl.[4] ..... F24F 13/072

[52] U.S. Cl. ..... 98/41.3; 98/40.09; 98/40.16

[58] Field of Search ..... 98/36, 40.07, 40.09, 98/40.14, 40.16, 40.18, 41.3; 251/326, 329

[56] References Cited

U.S. PATENT DOCUMENTS

| | | | |
|---|---|---|---|
| 2,526,828 | 10/1950 | Phillips | 98/40.07 X |
| 2,684,827 | 7/1954 | Hohnstein et al. | 251/176 X |
| 3,250,205 | 5/1966 | Lambert | 98/40.16 |
| 3,406,623 | 10/1968 | Lambert | 98/40.16 |
| 3,673,946 | 7/1972 | Ragland | 98/40.16 |
| 3,759,159 | 9/1973 | Rachlin et al. | 98/40.16 |

FOREIGN PATENT DOCUMENTS

| | | | |
|---|---|---|---|
| 2006928 | 9/1971 | Fed. Rep. of Germany | 98/40.16 |
| 1234964 | 2/1967 | German Democratic Rep. | 98/40.16 |
| 1025481 | 4/1966 | United Kingdom | 98/40.09 |

*Primary Examiner*—Harold Joyce

*Attorney, Agent, or Firm*—Brumbaugh, Graves, Donohue & Raymond

[57] ABSTRACT

An improved air diffuser or air boot has a unique incremental air dampering and air pattern control mechanism, namely a plurality of independent adjacent flat damper plates or blades which are adjustably attached to an inner surface of a bottom ledge just above an air outlet throat and are slideable across the throat. Each plate may be manually or automatically slid from its open position resting on the ledge to a closed position where it butts against the far side of the air outlet throat.

4 Claims, 8 Drawing Figures

AIR DIFFUSER

BACKGROUND OF THE INVENTION

The present invention concerns an improved ceiling recessed air supply diffuser or air boot. In order to simplify and improve the ceiling appearance, the air diffuser or boot also may be combined with recessed linear fluorescent fixtures, recessed electrical tracks, or other recessed linear devices.

A slot type air diffuser or boot generally comprises an elongated enclosed air chamber having an air inlet collar at a side or on top, and an elongated air outlet throat at the bottom.

In order to be successful and comfortable, an air supply system must deliver air from suitable locations, in appropriate volumes, in proper directions, and at correct velocities.

Any large reductions in volume are not normally made in an air diffuser or boot. Instead, they are made further up-stream to avoid excessive noise generation; but minor reductions, called "trimming" adjustments, are performed in the slot type air diffuser or boot itself and a dampening device must be provided for this purpose. In the prior art the means to reduce the air flow in a traditional slot type air diffuser or boot has been a butterfly damper in the air inlet collar or a hinged full-length damper in the air outlet throat.

Except in very high-ceilinged spaces, the proper direction for air emitted from the air boot is always in a tight horizontal pattern closely hugging the ceiling. In a recessed linear slot type air supply device the primary means for effecting such a horizontal pattern is always a projection, at the bottom of the throat and approximately in the plane of the ceiling under-surface, which deflects the air across the ceiling. The air in the throat must first be directed toward this projection and traditionally this has been accomplished by a flat or curved blade within the throat and equal to it in length. Often this blade has also been hinged to also serve as a volume control or damper.

All of these traditional means for trimming air volume and directing air flow have had the severe disadvantage that they use elements that hinder and disrupt the air flow. This happens especially when the slot type air diffuser or boot is operating near its maximum volume levels as established by pressure and noise criteria, since these elements always remain within the air path and severely limit the air diffuser or boot performance.

Another disadvantage of the traditional slot type air diffuser or boot occurs at reduced volume levels of performance. With reduced volume the pressure and velocity is also decreased, and the air diffuser or boot is incapable of projecting the emitted air to any great distance across the ceiling. Because high supply velocities at the outlet are necessary to maximize room air induction, the process by which the air stream induces movement into a much larger air mass, this may result in failure of air coverage in the conditioned space.

The traditional slot type air diffuser or boot used alongside a recessed fluorescent fixture is mounted directly on and is fully supported by the fixture. Such an air boot has its entire throat engaged in a socket portion of the fixture which runs the full length of the fixture, and the boot is stabilized by a bracket attached between it and the top of the fixture. Consequently, the air boot cannot be installed in the ceiling until after the light fixture has been installed, which is highly undesirable for building scheduling flexibility.

SUMMARY OF THE INVENTION

The object of the present invention is to overcome the above-mentioned disadvantages of the traditional linear slot type air diffuser or boot and also to provide an air diffuser with other advantages.

In accordance with the present invention, an improved air diffuser is provided with a unique incremental air dampering and air pattern control mechanism, namely a plurality (e.g., five) of independent adjacent flat damper plates or blades which are adjustably attached to an inner surface of a bottom ledge just above an air outlet throat and are slideable across the throat. Each plate may be manually or automatically slid from its open position resting on the ledge to a closed position where it butts against the far side of the air outlet throat. While intermediate positions are possible and may permit added nuances of control, in normal usage each blade is adjusted to be either fully open or fully closed.

In addition to the control blades the air diffuser of the present invention is also characterized by a unique tapered throat configuration, wherein the throat is widest at the top and tapers down to a narrower width at the bottom. This shape reduces air turbulence, and due to increasing velocity toward the bottom of the boot, it also serves to direct the air stream more efficiently toward the projection at the bottom of the throat.

The air diffuser or air boot of the present invention, which can be used independently or alongside a light fixture, electrical track or other linear element, represents an advance in supply air diffusion over the traditional slot type air diffuser or boot in the following two significant respects:

1. Lowered Pressure and Reduced Noise at High Operating Levels

In the upper half of the air volume operating range of the air diffuser of the present invention, the dampering and pattern control blades are used in their open position, and they add no measurable turbulence to the air flow and have virtually no constrictive effect on the air passage because they lie alongside instead of within the air path. Compared to air diffusers or boots with butterfly dampers and/or hinged flat or curved blades, this affords reduced internal pressure losses and lowered noise at a given air delivery volume, or alternatively it permits a greater air delivery volume at the same pressure and noise levels.

2. High Room Air Induction at Low Air Supply Volume

In the lower half of the air volume operating range of the air diffuser of the present invention, one or more of the slideable damper or pattern control blades may be closed so that the air is in effect passing through a shortened slot and the active length of the air diffuser or boot is reduced. This increases the volume per active unit of length and consequently the pressure and velocity, and provides an air distribution pattern that hugs the ceiling, gives very long distances of throw, and assures satisfactory air induction at much lower volume levels than other similar existing devices. The closing of the slideable blades may be pre-set manually when the air system is balanced following installation, or it may be constantly controlled by a motor responsive to a standard automatic air volume control system which is itself controlled by room temperature fluctuations.

Another advantage of the air diffuser or boot of the present invention is that adjustments for dampering or for pattern control are normally made in discreet steps, instead of the infinitely variable controls used in previous devices. Each blade is either wide open or fully closed and the effect of specific open-and-closed blade configurations will quickly become known to an experienced air balancer.

A further advantage of the air diffuser or boot of the present invention applies to double throat embodiments thereof. Here dual sets of blades can control the slot air diffuser or boot so that air is emitted to either one side or the other or in both directions simultaneously with air pattern and trimmed volume variable separately.

An additional advantage of the air diffuser or boot of the present invention is that it may be employed independently as a pure air delivery device, or it may be readily combined with fluorescent lighting fixtures or with an electrical track or with other linear architectural ceiling elements, with portions of these other elements performing some of the air delivery device functions such as the air directing projection at the bottom of the throat, or acting as a portion of the throat itself. Such sharing of functions not only simplifies manufacture, but more importantly simplifies the appearance of the elements involved and therefor of the ceiling in which they are installed.

A further advantage of the air diffuser or boot of the present invention is that even when used in combination with a fluorescent light fixture, it is mounted directly on and is supported by the ceiling support members instead of by the light fixture itself, so that it can be installed either before or after the light fixture is installed. Still a further advantage is that it may have a simple means to attach it to the light fixture for stabilization and vibration prevention, and that this means is accessible through the inside of the light fixture after the light fixture is installed. This permits the light fixture to be disengaged from the air diffuser or boot without breaking through the ceiling so that the light fixture can be moved aside and its space used to provide access into the ceiling for maintenance or construction.

DESCRIPTION OF THE DRAWINGS

In the non-scalar drawings.

DETAILED DESCRIPTION OF THE INVENTION

Figure 1:
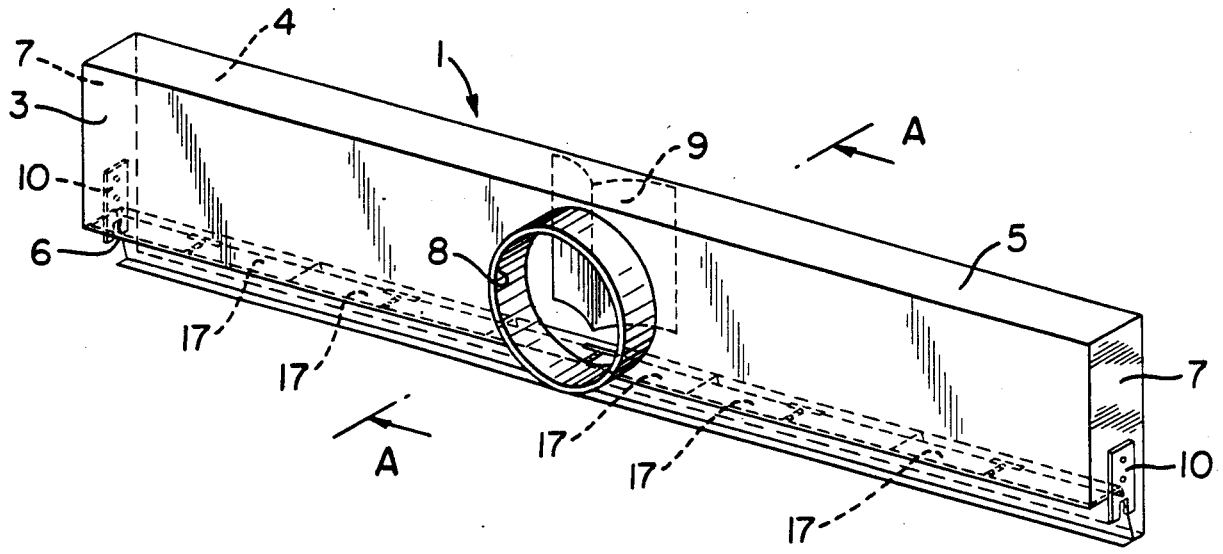
FIG. 1 is a perspective view of an embodiment of the air diffuser of the present invention.
Figure 2:
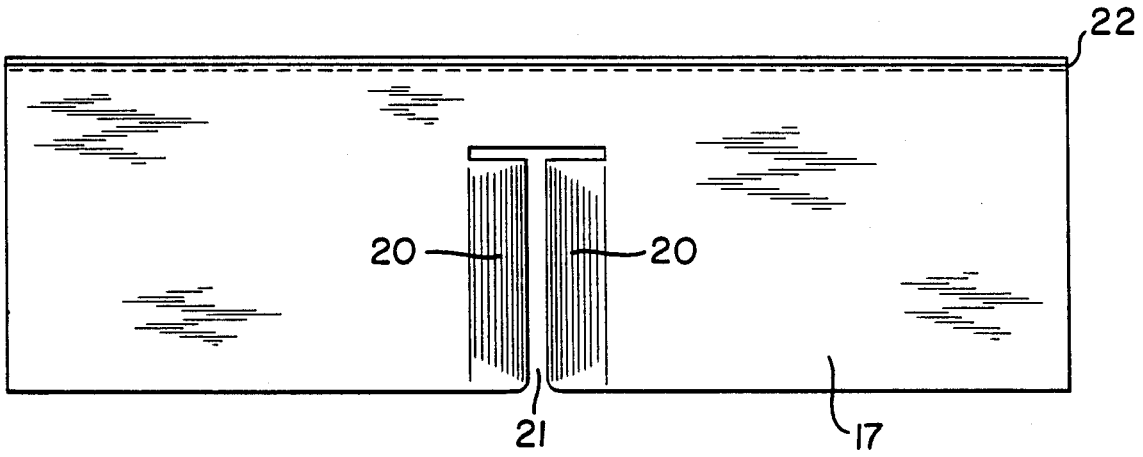
FIGS. 2 and 3 are a top plan view and a front end view, respectively, of a damper plate or blade.
Figure 3:
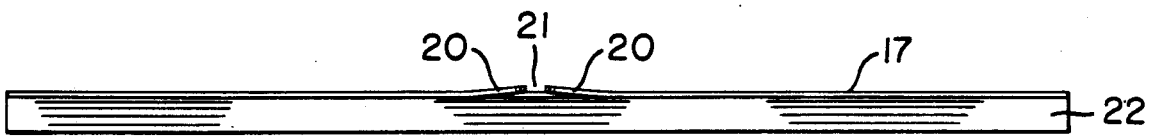

Referring to FIGS. 1–5, the air diffuser 1 comprises an elongated chamber or box or plenum 2 enclosed by a front wall 3, a rear wall 4, a top wall 5, a bottom wall or ledge 6 and two end walls 7. The front wall 3 has an air inlet collar 8 and the rear wall 4 has an opposed bifurcated arcuate air deflector 9. The two end walls 7 each have an inverted U-shaped bracket 10 which fits over the top of a ceiling support member S for directly mounting and supporting the air diffuser 1. The rear wall 4 (FIG. 5) can also have a rotatable winged fitting 11 with an intermediate washer 12 which can pass through an opposed slot in a linear fluorescent light fixture F having a reflector R and which can then be twist locked 90° to attach firmly the air diffuser 1 to the light fixture F and thereby prevent vibration during air flow. The rear wall 4 has a lower extension 13 opposite an inclined (8°–10°) wall 14 extending downwardly from the back end of the bottom wall or ledge 6 to form together an elongated downwardly tapered air outlet throat 15. Spacers 16 are located periodically along the air outlet throat 15.

A plurality (e.g., five) of independent adjacent flat air damper and air pattern control plates or blades 17 are adjustably attached to the inner surface of the bottom wall or ledge 6 just above the air outlet throat 15 via transverse rows of two rivets 18, the raised heads 19 of which rivets 18 frictionally engage an upwardly inclined (5°) portion 20 with a transverse T-shaped slot 21 in each plate or blade 17. Each plate or blade 17 has a downwardly inclined (8°–10°) flange 22 at the back end whose inclination is substantially the same as that of the adjacent downwardly inclined wall 14 to prevent air turbulence.

Figure 4:
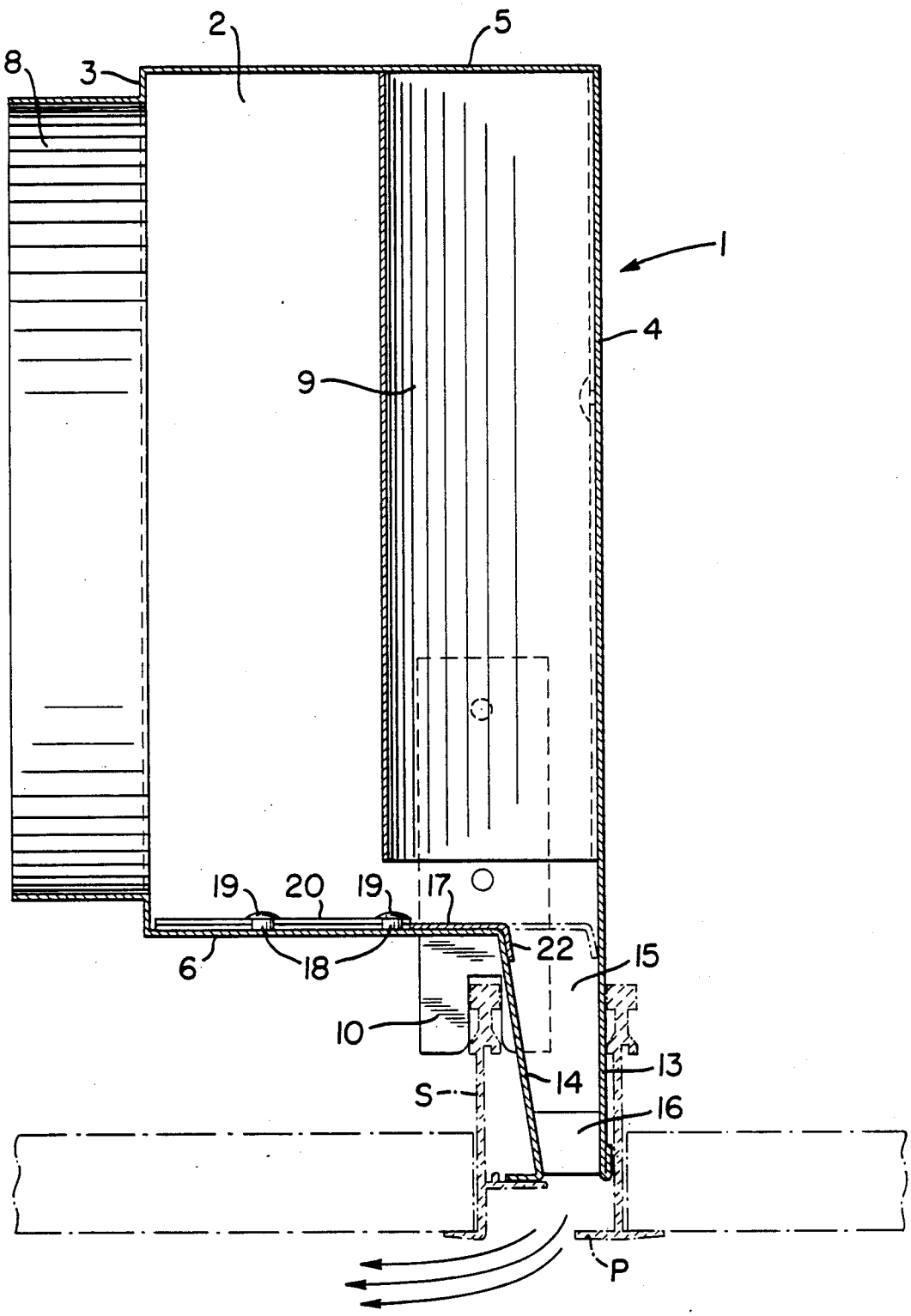
FIGS. 4 and 5 are sectional views along line A—A in FIG. 1 showing the air diffuser used independently (FIG. 4) and alongside a light fixture (FIG. 5)
Figure 5:
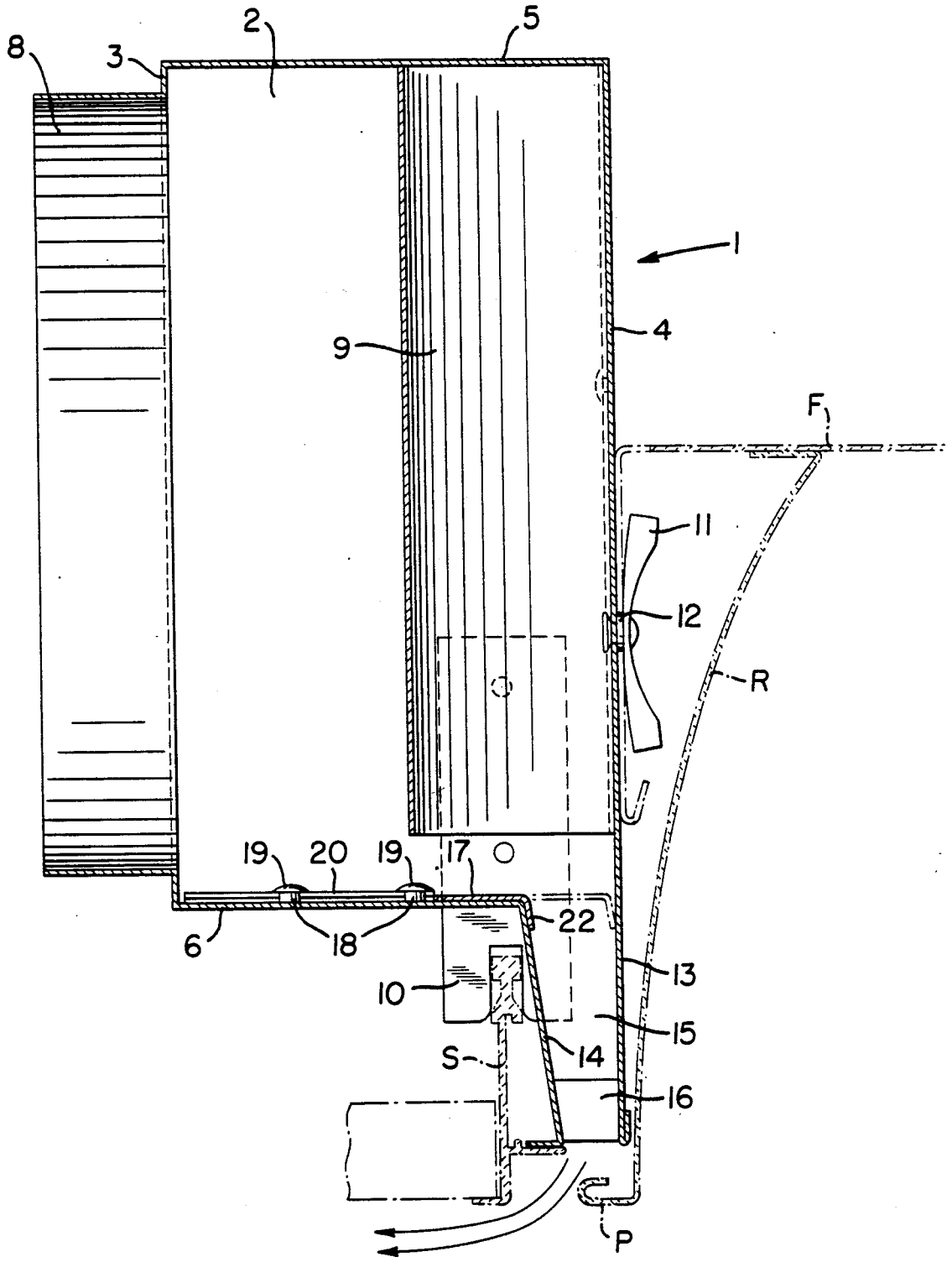

Each plate or blade 17 can be separately in an open throat position, as shown in solid line in FIGS. 4 and 5, or in a closed throat position, as shown in phantom line in FIGS. 4 and 5, or in any partially closed or intermediate position (not shown). The position of each plate or blade 17 can be manually adjusted by inserting a thin tool up through the throat 15 to engage the flange 22 and slide the plate or blade 17 transversely from the inclined wall 14 (open throat position) to the lower extension 13 (closed throat position) or vice versa or to any partially closed or intermediate position.

Figure 8:
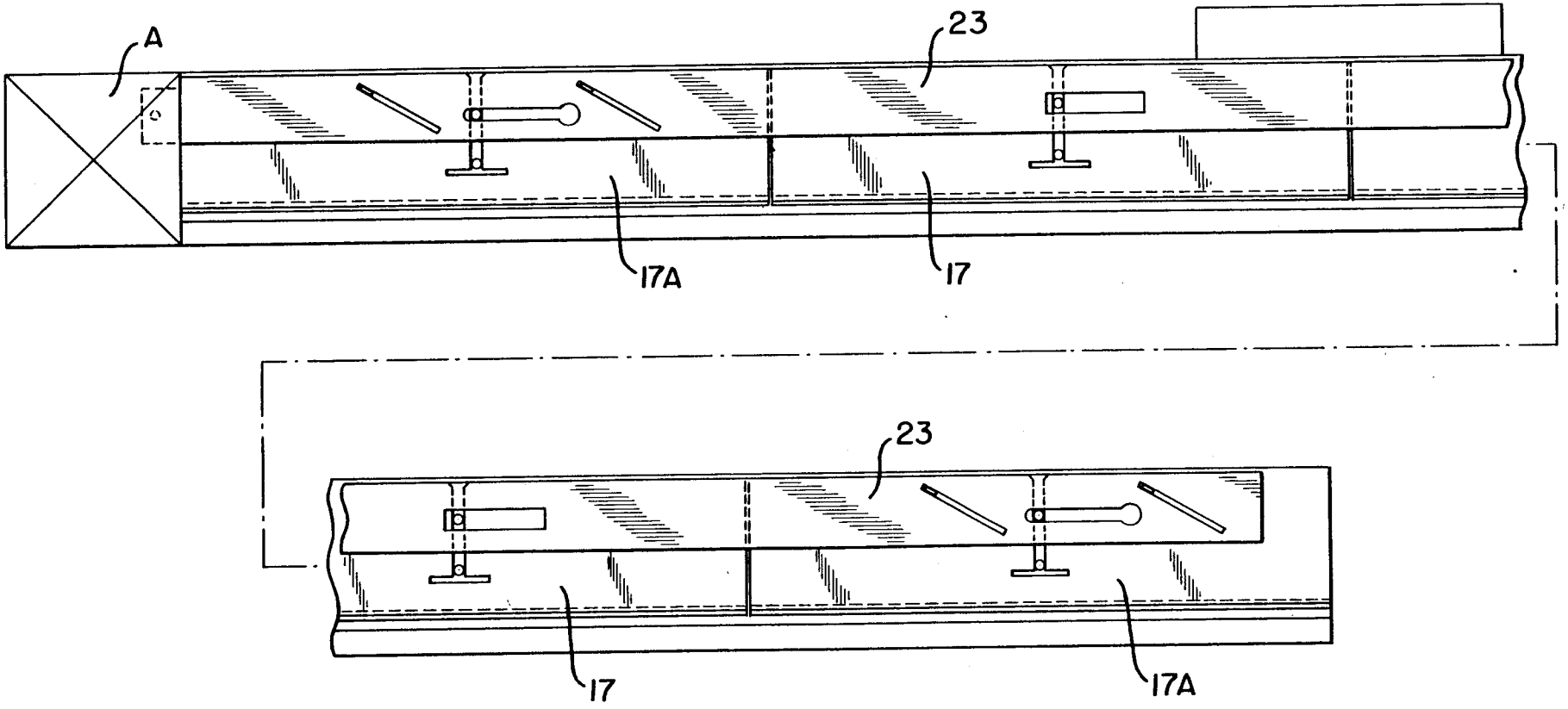
FIG. 8 is a diagrammatic top plan view of a plurality of the damper plates or blades having an automatic positioning actuator.

Alternatively, as shown diagrammatically in FIG. 8, a number of the plates or blades 17, for example, the two end plates or blades 17A, can be automatically positioned by an appropriate push-pull connecting bar or linkage 23 operated by a pneumatic actuator or electromechanical actuator A which is indirectly responsive to air volume.

Figure 6:
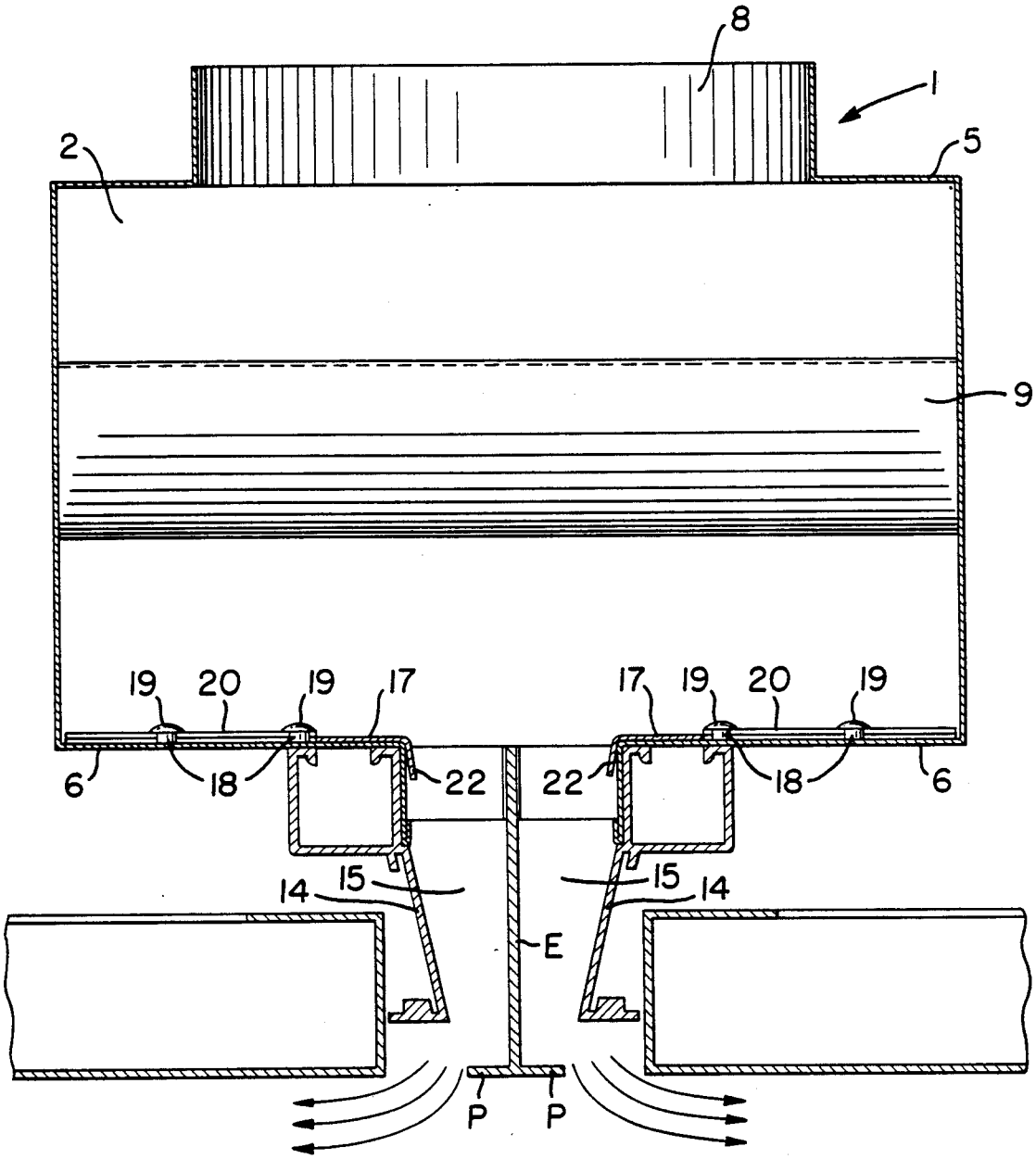
FIGS. 6 and 7 are end sectional views of double throat embodiments of the air diffuser of the present invention.
Figure 7:
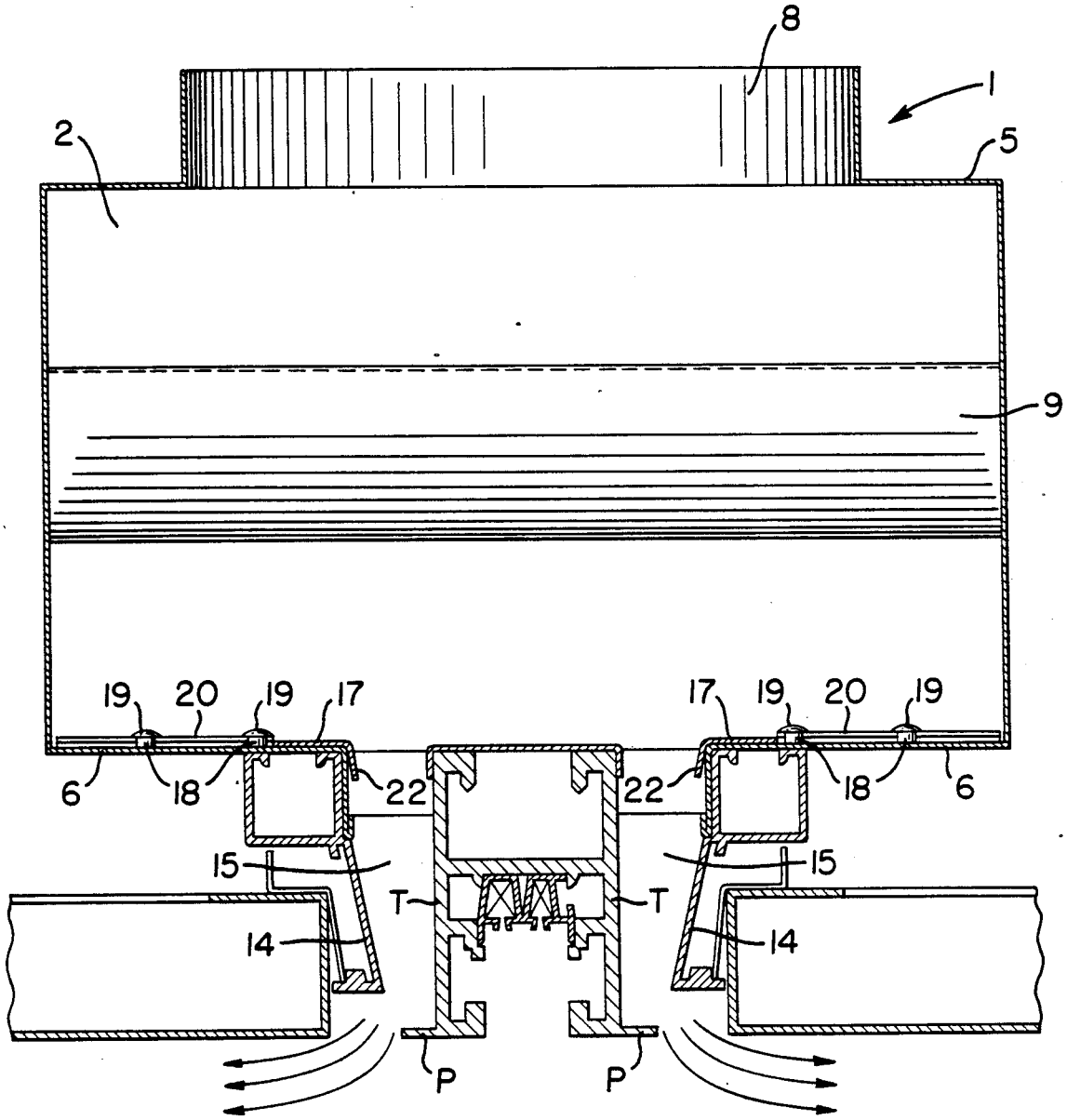

In the double throat embodiments of the air diffuser 1 of the present invention shown in FIGS. 6 and 7 having a top mounted air inlet collar 8, the air diffuser 1 has two sets of damper plates or blades 17, one set on each of two bottom walls or ledges 6 just above two downwardly tapered air outlet throats 15. In FIG. 6, a portion of the two throats 15 is formed by a central divider linear extrusion E, while in FIG. 7 a portion of the two throats 15 is formed by a linear electrical track T.

In FIGS. 4–7 the arrows indicate the horizontal air flow patterns from the throats 15 deflected by the associated horizontal projections P at the bottoms of the throats 15.

What is claimed is:

1. In an air diffuser having an elongated air chamber enclosed by walls, including end walls and a rear wall, and an air inlet collar and at least one elongated air outlet throat, the improvement which comprises the elongated air outlet throat has an upper end, a lower discharge end and a downwardly inclined tapered wall therebetween;

the elongated air chamber has a horizontal bottom ledge at the upper end of the elongated air outlet throat;

the horizontal bottom ledge has a plurality of independent adjacent flat damper plates adjustably attached to an inner surface of the horizontal bottom ledge and slideable across the upper end of the elongated air outlet throat; and each damper plate has a back end with a downwardly inclined flange at the back end whose inclination is substantially the same as that of the downwardly inclined tapered wall.

2. The air diffuser according to claim 1, wherein the horizontal bottom ledge has a transverse row of two rivets with raised heads for each damper plate and each damper plate has an upwardly inclined portion with a transverse slot which frictionally engages the rivet heads.

3. The air diffuser according to claim 1, wherein each end wall has an inverted U-shaped bracket which can fit over top of a ceiling support member for directly mounting and supporting the air diffuser.

4. The air diffuser according to claim 1, wherein the rear wall has a rotatable winged fitting which can pass through an opposed slot in a light fixture and which can then be twist locked to attach firmly the air diffuser to the light fixture.

* * * * *